United States Patent [19]

Curry

[11] Patent Number: 4,497,239

[45] Date of Patent: Feb. 5, 1985

[54] MUZZLE EJECTING SABOT CARTRIDGE FIREARM SYSTEM

[76] Inventor: Hugh R. Curry, P.O. Box 2274, El Cajon, Calif. 92021

[21] Appl. No.: 308,420

[22] Filed: Oct. 5, 1981

[51] Int. Cl.[3] ..... F41D 11/12; F42B 5/02

[52] U.S. Cl. ..... 89/198; 89/145 B; 89/179; 89/199; 89/14.6; 102/432; 102/471

[58] Field of Search ..... 89/1.7, 1.701, 1.702, 89/1.703, 1.704, 1.705, 1.706, 179, 198, 199, 145 B; 102/430, 431, 432, 471

[56] References Cited

U.S. PATENT DOCUMENTS

| | | | |
|---|---|---|---|
| Re. 2,636 | 6/1867 | Smith et al. | 102/471 |
| 53,168 | 3/1866 | Moffatt | 102/471 |
| 1,335,500 | 3/1920 | Hasting | 89/199 |
| 1,416,827 | 5/1922 | Holmes | 89/145 B |
| 2,440,568 | 4/1948 | Arter | 102/430 |
| 2,492,279 | 12/1949 | Fowler | 89/1.705 |
| 2,703,529 | 3/1955 | Tuckerman et al. | 102/437 |
| 3,724,376 | 4/1973 | Kordas et al. | 102/432 |
| 3,738,219 | 6/1973 | Febres | 89/1.705 |
| 3,890,880 | 6/1975 | Gandy | 89/1.705 |

FOREIGN PATENT DOCUMENTS

| | | | |
|---|---|---|---|
| 264009 | 9/1949 | Switzerland | 89/1.703 |
| 9869 | 2/1908 | United Kingdom | 89/199 |

*Primary Examiner*—Stephen C. Bentley
*Attorney, Agent, or Firm*—Frank D. Gilliam

[57] ABSTRACT

A muzzle ejecting sabot cartridge firearm system for use in a weapon having an elongated gun barrel, an action mechanism, and an elongated bolt mounted within the bore of the action mechanism. The bore of the action mechanism and the bore of the gun barrel are in co-axial alignment and the forward end of the action mechanism is in communication with the rear end of the gun barrel. The bolt has an elongated bore extending inwardly from its base end that communicates with a relieved portion in the front face of the bolt to allow passage of gases released from a cartridge that has been fired. The diameter of the bore of the action mechanism is greater than the diameter of the bore of the gun barrel thereby forming a shoulder at the front end of the action mechanism that functions to capture the peripheral rim along the back end of a sabot cartridge at the initial stage of firing the cartridge. The front end of the bolt face has an annular rim that peripherally surrounds its relieved portion and this acts as a firing pin when driven against the peripheral rim along the back end of a sabot cartridge.

7 Claims, 6 Drawing Figures

MUZZLE EJECTING SABOT CARTRIDGE FIREARM SYSTEM

BACKGROUND OF THE INVENTION

The invention relates to a firearm system, and more particularly to a muzzle ejecting, sabot cartridge firearm system.

In the past previous firearm system utilized bullets that separated from their cartridges within the action mechanism of the weapon at the time of detonation of the bullet by the firing pin located on the forward end of a bolt mechanism of a firearm.

It is an object of the invention to provide a novel muzzle ejecting, sabot cartridge firearm system that has a hollow bolt mechanism open at both its forward and rearward ends.

It is also an object of the invention to provide a novel muzzle ejecting sabot cartridge firearm system that utilizes a novel sabot cartridge that is designed to have its cartridge case exit from the front end of the gun barrel of the firearm.

It is an additional object of the invention to provide a novel muzzle ejecting sabot cartridge firearm system that is easy to manufacture and assemble.

It is an additional object of the invention to provide a novel muzzle ejecting sabot cartridge firearm system that may be either manually operated or incorporated into an automatic operation.

SUMMARY OF THE INVENTION

The novel muzzle ejecting sabot cartridge firearm system has a hollow bolt firearm action. It requires a novel muzzle ejecting sabot cartridge type of ammunition. Although, the theoretical configuration described is of a rifle, the concept is adaptable to any weapons designed using cartridge ammunition. The system will be described as being manually operated but it is also feasible to use the novel system with an automatic operated weapon.

The novel system is designed around a hollow one piece bolt (which also acts as a firing pin) operating in the manner of a piston from a sealed cylinder in the rear of the action housing. Manual (push, pull) operation would be similar to a conventional rifle except that it would not rotate, and there would be no mechanical breech locking mechanism. There would also be no extracting or ejecting mechanisms, and that portion in the action housing used as an ejection port would be covered.

Rim fire ammunition would be fed into the action from a lip-less disposable plastic magazine, which would open (releasing rounds to rest against the covered portion of the action) only after being fully inserted to a sleeve on the under side of the action. This sleeve which is a part of the action, would also depress a button on each side of the plastic magazine, putting tension on an elastic band inside the magazine that draws on the magazine follower to feed succeeding rounds of ammunition.

With the hollow bolt withdrawn into the cylinder, a round will be fed into direct alignment between the bolt face and the bore, and held in this position by the covered action. In its most simple form, the weapon could be fired from this position by allowing the bolt to be driven forward by the operating spring. A round of ammunition would be inserted into the bore, with the rim of the cartridge stopping at the shoulder located at the entrance to the gun barrel bore and the primer of the cartridge would be fired by the rim face of the bolt. On ignition, the cartridge/bullet combination would not separate, the base of the cartridge would uniformly rupture and the exploding propellant channeled through the hollow core of the bolt to the chamber in the rear of the action housing. This would relieve the greater portion of the propellant's explosive energy from the forward end of the bolt, and it would be held in its forward closed position by pressure of the operating spring and the weight of the bolt carrying mechanism while the cartridge/bullet combination is being driven through the gun barrel.

As the forward portion of the cartridge/bullet combination emerge at the muzzle end of the gun barrel, the propellant gases cause the forward portion of the cartridge case to expand. As this happens a flange on the inside edge of the cartridge case mouth is withdrawn from a corresponding groove at the base end of the bullet and a separation of the cartridge/bullet combination is accomplished.

Problems with friction between the cartridge case wall and the weapons bore as the cartridge/bullet combination is being driven through the barrel, can be overcome by texturing the effected case surface and perforating the effected case wall to allow free flow of pressure between these areas. These perforations would be sealed with a non-foiling sealant prior to firing, and would only burn or blow out as the cartridge was fired.

DESCRIPTION OF THE PREFERRED EMBODIMENT

Figure 1:
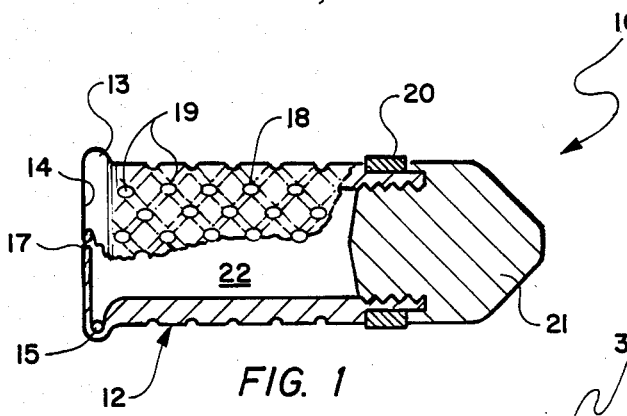
FIG. 1 is a side elevation view of the novel sabot cartridge having portions broken away to illustrate desired areas in cross-sectional view.

A sabot cartridge, generally designated numeral 10 is illustrated in FIG. 1. It has a tubular cartridge case 12 having a rim 13 formed on its lateral edges adjacent its base 14. A priming material 15, such as fulminate mercury is located in this annular rim. Base 14 has a centrally located rupture point 17 that may be formed by relieving the thickness of the base at that point or by perforating it and then filling it with a non-foiling plastic sealant that would burn or blow out as the cartridge was fired. The external surface of the tubular cartridge case 12 has a texture surface such as a raise diamond plate section. It would have a plurality of perforations 18 that are filled by plugs 19 of a non-foiling plastic sealant that would burn or blowout as the cartridge is fired. An annular gas check ring 20 acts to control passage of a major portion of the gas that will exit through perforations 18 and keep this gas from passing the front of the cartridge. A bullet 21 is attached to the front of cartridge case 12 and a powder chamber 22 is formed within the cartridge case.

Figure 2:
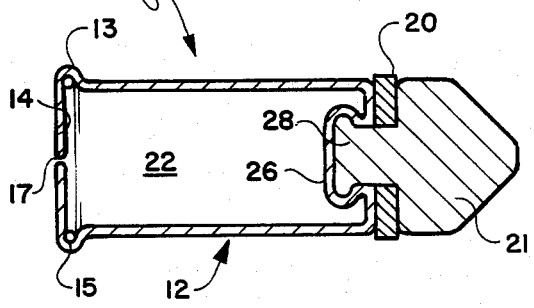
FIG. 2 is a cross-sectional view of a first alternative sabot cartridge.

The sabot cartridge illustrated in FIG. 2 is designated numeral 25 and its components that are similar to that of the sabot cartridge 10 are identified by like numerals. Sabot cartridge 25 would also have a textured, perforated surface similar to that of sabot cartridge 10. The forward end of its cartridge case 12 would have a sealed forward end 26 formed wih a recess therein that matingly conforms to a button portion 28 formed on the rear end of bullet 21. The gas check rings 20 have a diameter slightly larger than that of the diameter of the cartridge case in order to perform their function which was described previously.

Figure 3:
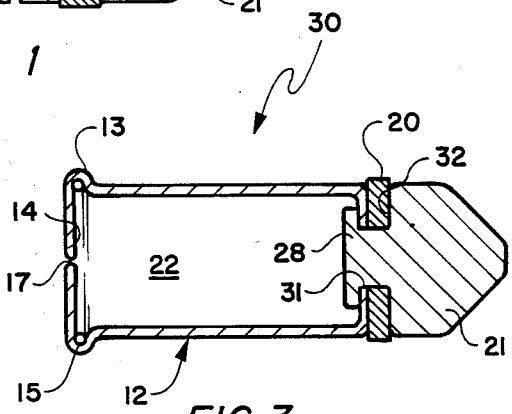
FIG. 3 is a cross-sectional view illustrating a second alternative sabot cartridge.

The sabot cartridge illustrated in FIG. 3 is generally designated numeral 30. Its tubular cartridge case 12 has an annularly inwardly extending lip 31 that matingly engages with the annular groove 32 at the base of bullet 21.

Figure 4:
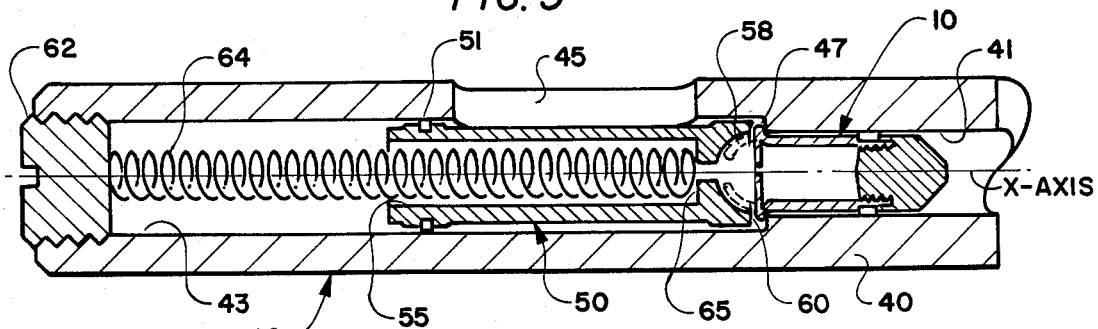
FIG. 4 is a cross-sectional view illustrating a sabot cartridge immediately prior to its detonation in a gun barrel.

FIG. 4 illustrates one of the initial stages of the novel firearm system. It illustrates the gun barrel 40 having a bore 41. The action mechanism 42 has a bore 43 oriented with its forward end in communication with the rear end of gun barrel 40. Both bore 41 and 43 are in co-axial alignment along the x-axis. A combination lateral breech and loading gate 45 is formed in the lateral wall surface of action mechanism 42 in its forward end. The diameter of bore 43 is greater than the diameter of bore 41 to form a shoulder 47 at the front end of action mechanism 42 that functions to capture the peripheral rim 13 along the back end of sabot cartridge 10.

An elongated hollow bolt 50 has a diameter slightly less than that of bore 43. An annular sealing ring 51 functions to prevent most of the exploding propellant gases from passing between the sides of the hollow bolt 50 and the surface of bore 43. Hollow bolt 50 has a front face 53 and a rear base 54. Bore 55 extends inwardly from base 54 and it communicates with an aperture 57 which in turn communicates with the relieved portion 58 and bolt face 53. The forward end of hollow bolt 50 has an annular rim 60 that surrounds the relieved portion 58 and this structure functions in the manner of a firing pin.

A plug 62 closes the rear end of action mechanism 42 and a main spring 64 is captured between the end of plug 62 and shoulder 65 of bore 55 of the hollow bolt. The illustration of main spring 64 within bore 43 would be primarily for purposes of a demonstration device. A production model weapon would use a design having springs positioned outside the chamber of the action mechanism for driving hollow bolt 50 forwardly upon actuating the trigger of the weapon.

Figure 6:
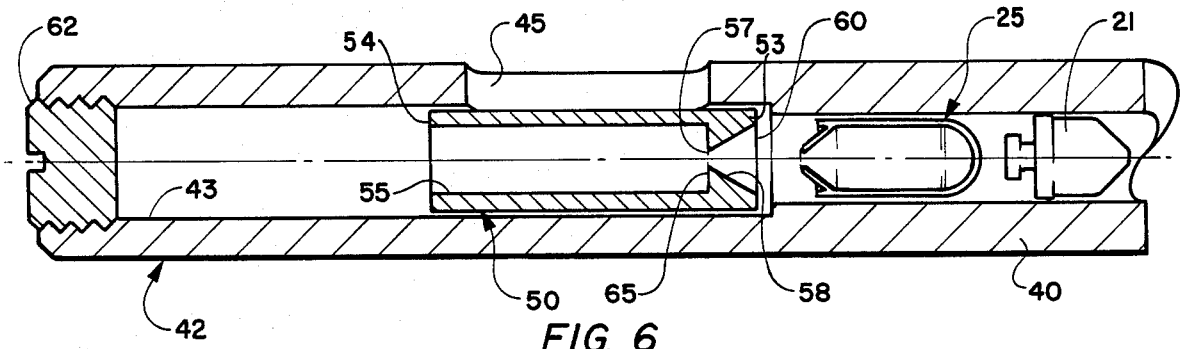
FIG. 6 is a cross-sectional view illustrating how the sabot cartridge illustrated in FIG. 2 separates upon detonation.
Figure 5:
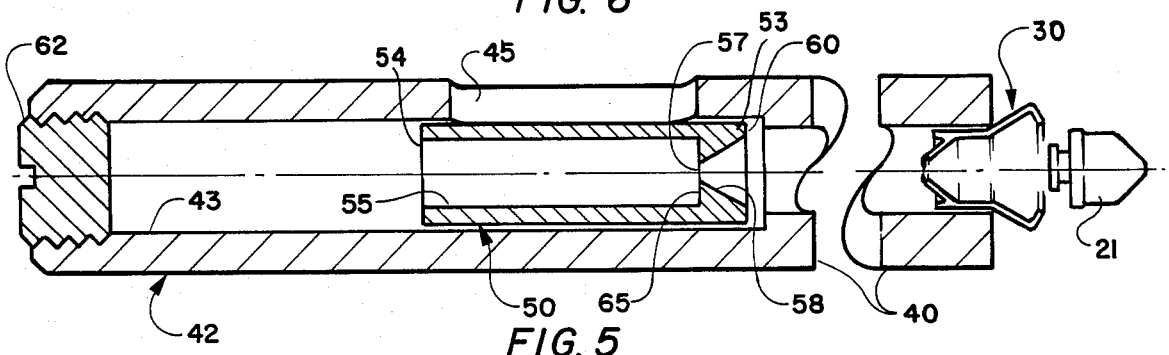
FIG. 5 is a cross-sectional view illustrating a manner in which the sabot cartridge illustrated in FIG. 3 separates upon exiting from the gun barrel.

In operation as the bolt 50 is pulled to its rearward most position, a sabot cartridge would be automatically loaded through loading gate 45 into bore 43 of the action mechanism 42. As the trigger of the fire-arm is pulled, hollow bolt 50 will travel forwardly to the position illustrated in FIG. 4. Annular rim 60 will then contact the annular rim 13 on the sabot cartridge. This malleable rim at the base of the cartridge (the primer) is intended to collapse and to compress to the diameter of the bore 41 without fracturing prior to being driven through barrel 40. Upon ignition the explosive propellant within the sabot cartridge will uniformly rupture its base end 14 (without fracturing or separating the components) so that the explosing propellant exits from this ruptured opening in the base and is channeled into the hollow core of the bolt and the sealed chamber in the base of the action mechanism 42. The propellant then drives the cartridge/bullet 10 through the barrel 40. FIG. 5 illustrates the sabot cartridge 30 that is designed to separate at the moment of exit from the muzzle end of barrel 40. FIG. 6 illustrates the sabot cartridge 25 which is designed to separate before it exits from the muzzle end of barrel 40.

In this invention, the action mechanism bore 43 acts as a gas expansion chamber. When the propellant charge disposed in the powder chamber 22 ignites, the base end of the cartridge case is ruptured and reformed by the expanding gases such that the case rim no longer prevents passage of the case through the barrel bore. The expanding gas passes into the action mechanism bore and creates pressure. The resultant pressure in this gas expansion chamber is sufficient to propel the case through the barrel and out the muzzle.

I claim:

1. A muzzle ejecting sabot cartridge firearm system comprising:

an elongated projectile launching barrel having an axially extending bore and having a muzzle end and a rear end;

an action mechanism afixed to the rear end of the barrel;

a gas expansion chamber defined by the reaction mechanism and in communication with the barrel bore;

a tubular cartridge case closed at a base end;

an annular rim formed by the cartridge case adjacent the base end, the diameter of the rim being suitably larger than the diameter of the barrel bore;

an annular groove internal to the cartridge case and defined by the annular case rim;

a projectile detachably fixed to a front of the cartridge case, the cartridge case and the projectile being disposed projectile first in the barrel bore such that the rim of the case abuts the rear end of the barrel, the case rim preventing further intrusion of the case into the barrel;

a closed chamber defined by the cartridge case and the projectile;

an expanding gas propellant charge disposed within the cartridge chamber; and a primer means disposed within the annular groove for igniting the propellant charge, said primer is adapted to be ignited by physical shock from a striking means comprising a moveable rod with a striking face comprising a peripheral rim surrounding a centrally located relieved portion, the striking face rim being adapted to strike the annular rim portion of the cartridge case, the relieved portion being adapted to provide enough space for the base end of the cartridge case to rupture and be reformed by the expanding gases of the ignited propellant charge such that the case rim no longer prevents passage of the cases through the barrel, the resultant pressure in the gas expansion chamber being sufficient to propel the case through the barrel and out the muzzle.

2. The system of claim 1 wherein the gas expansion chamber comprises an axially extending bore which is in co-axial alignment with the barrel bore, the moveable rod being disposed therein and adapted to reciprocal movement therein.

3. The system of claim 1 or 2 wherein the moveable rod is a bolt means having a gas passage means therethrough.

4. The system of claim 1 or 2 wherein the means for detachably affixing the projectile to the front of the cartridge case comprises a button member formed on the rear end of the projectile that interengages with an inwardly extending annular lip formed at the forward end of the cartridge case.

5. The system of claim 1 or 2 wherein the means for detachably affixing the projectile to the front end of the cartridge case comprises a button member formed on the rear end of the projectile that interengages with a mating front end wall of the cartridge case.

6. The system of claim 1 further comprising an annular gas check-ring positioned between the forward end of the cartridge case and the projectile, the gas check-ring having a diameter greater than that of the cartridge case.

7. The system of claim 1 wherein the cartridge case has a plurality of perforations formed in its lateral wall surface, said perforations being filled with a plastic plug or sealant designed to blow out upon detonation of said cartridge.

* * * * *